United States Patent [19]

Olszewski et al.

[11] 4,176,893

[45] Dec. 4, 1979

[54] RELIABLE SHEATH BONDING CONNECTOR AND METHOD OF MAKING

[75] Inventors: Jerzy A. Olszewski, Edison; Towheed Ramy, Jersey City, both of N.J.

[73] Assignee: General Cable Corporation, Greenwich, Conn.

[21] Appl. No.: 845,039

[22] Filed: Oct. 25, 1977

[51] Int. Cl.[2] ..... H01R 3/06

[52] U.S. Cl. ..... 339/14 R

[58] Field of Search ..... 339/14 R, 14 L

[56] References Cited

U.S. PATENT DOCUMENTS

| | | | |
|---|---|---|---|
| 3,701,839 | 10/1972 | Smith | 339/14 R |
| 3,753,204 | 8/1973 | Thompson et al. | 339/14 R |

*Primary Examiner*—Roy Lake
*Assistant Examiner*—DeWalden W. Jones
*Attorney, Agent, or Firm*—Roy C. Hopgood; John M. Calimafde; Charles W. Neill

[57] ABSTRACT

The subject invention relates to a new connector assembly design for making a low resistance, stable electrical connection to a plastic coated aluminum shield adhering to and underlying polyethylene jacket of telephone cables. When the connector in accordance with the invention is applied across the composite sheath, it eliminates the creep strain exhibited by the polyethylene jacket and aluminum shield and results in a stable low resistance electrical connection, which is essential for noise-free operation of the cable and good lightning protection of enclosed telephone circuits.

19 Claims, 4 Drawing Figures

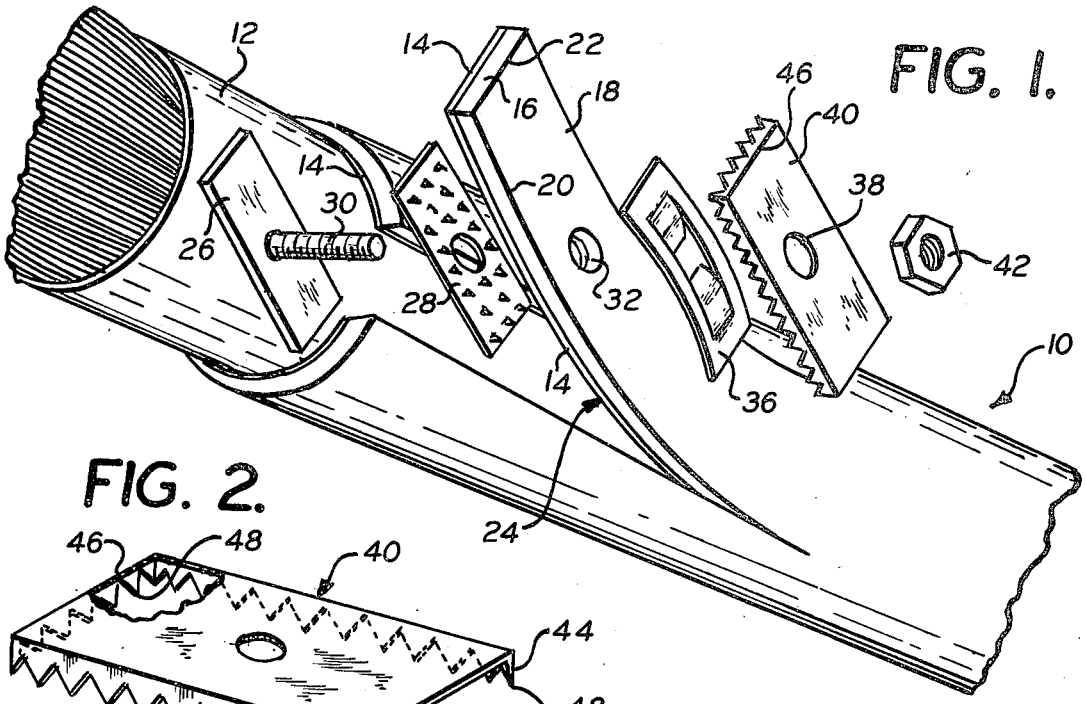
FIG. 1.
FIG. 2.
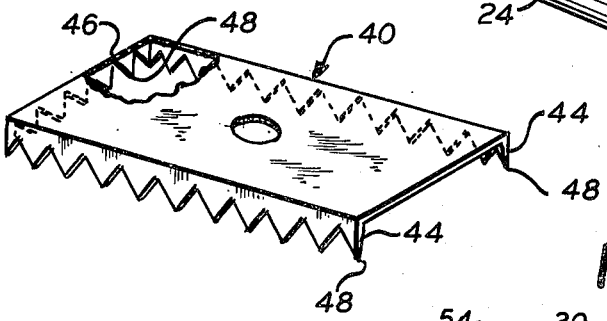
FIG. 3.
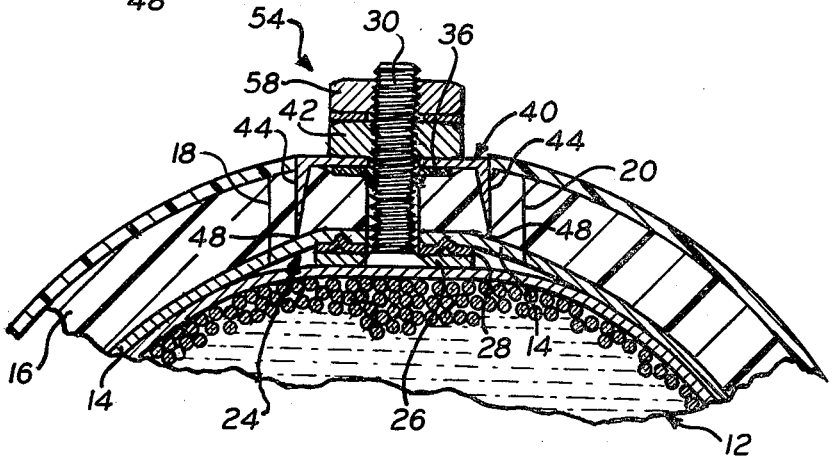
FIG. 4.
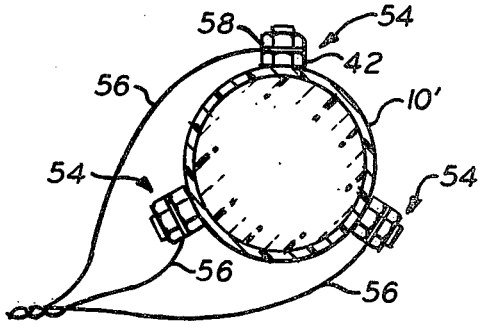

RELIABLE SHEATH BONDING CONNECTOR AND METHOD OF MAKING

BACKGROUND AND SUMMARY OF THE INVENTION

The subject invention relates to a reliable connector for bonding shields of telephone cables to ground and in particular for the polyethylene coated aluminum shield adhering to and underlying a polyethylene jacket.

The most commonly used devices for providing shield bonding consist of a connector composed of two or more parts assembled together by stud and a nut. The lower sections of the connector, incorporating the stud, are placed in contact with the shield under the cable outer jacket. The other part of the connector rests on top of the cable jacket, whereupon the nut is threaded onto the stud, electrical contact is established between the shield through the lower sections then through the threaded stud when the nut is tightened. This technique is operative to provide shield bonding but it involves many problems.

The electrical contact resistance has been found to increase substantially with time and, as a result, the telephone operating companies have experienced noisy lines.

The high increase in contact resistance with commercially available connectors is attributed to the loss of contact between the lower section and the aluminum shield as a result of aluminum oxidation at the contact points. Aluminum, as well as the polyethylene cable jacket, which is normally low density type, have the tendency to cold flow or creep under sustained load, and, in addition, the dimensional stability of the jacket is very sensitive to temperature fluctuation. Therefore, with time, relocation of the initially applied pressure at the contact points takes place and aluminum oxide forms which is non-conductive and consequently results in increasing the electrical contact resistance.

The main problem, of course, is the bonded composite cable sheath. The coating on the aluminum shield was initially designed to eliminate corrosion problems. Further sheath modification consisted of bonding the shield to the polyethylene cable jacket. The latter improved the mechanical characteristics of the sheath and reduced substantially the moisture permeation into the cable core. The laminated composite sheath, however, created problems in bonding such sheath to ground, or in establishing electrical shield continuity at splice points, since high adhesion between the shield and the jacket made separation of the two difficult, if not practically impossible. This, in turn, created a necessity for electrical bonding of the composite sheath.

The invention described in this specification has built-in features which compensate for creep strain and, in addition, prevent oxidation of the aluminum at the contact points. A connector, according to the present invention, provides and maintains a stable low resistance electrical connection to a metallic shield when applied over the composite sheath of the plastic telephone cable. The present invention overcomes disadvantages of the prior art by providing means by which the contact resistance remains low and stable.

Other objects, features of the invention will appear or be pointed out as the description proceeds.

BRIEF DESCRIPTION OF DRAWING

In the drawing, forming a part hereof, in which like reference characters indicate corresponding parts in all the views:

FIG. 1 is an exploded isometric view showing the sheath bonding connector of this invention and illustrating the order of assembling its components at the end of a composite laminated cable sheath;

FIG. 2 is an isometric view of the clamping shoe used on the assembly shown in FIG. 1;

FIG. 3 is an enlarged, fragmentary view showing the sheath bonding connector of this invention when assembled with the cable shown in FIG. 1; and FIG. 4 is a diagrammatic view showing the use of a plurality of sheath bonding connectors on the same cable.

DESCRIPTION OF PREFERRED EMBODIMENT

FIG. 1 shows a communication cable 10 having a core 12 surrounded by metal shield 14. A plastic outer jacket 16 is adhered to the metal shield 14 in accordance with conventional practice.

The shield 14 and jacket 16 are cut through along two lines 18 and 20 which are spaced from one another and which extend lengthwise of the cable. If the lines 18 and 20 do not extend to the end of the shield 14 and jacket 16, the shield and jacket are also cut along a line 22 which extends with a circumferential component and with the lines 18 and 20 forms a tab, indicated generally by the reference character 24.

The tab 24 can be hinged upward away from the core 12, at the end of the tab remote from the line 22, as shown in FIG. 1. This makes the metal shield 14 accessible for connecting it with the other parts of this invention.

There is an inner shoe comprising a plate 26 and a shim 28 which rests on the plate 26 but is shown spaced from it in FIG. 1 for clearer illustration. A fastening element 30, shown as a threaded screw, connects with the plate 26 and passes through an opening in the shim 28.

The fastening element 30 extends through an opening 32 in the tab 24, and when the structure is assembled, the fastening element 30 holds the plate 26 and shim 28 in firm contact with one another and holds the shim 28 in firm contact with the metal shield 14 which is preferably adhered to the outer jacket 16. The fastening element 30 extends through a leaf spring 36 and then through an opening 38 in a clamping shoe 40. A nut 42 screws over the end of the fastening element 30 and clamps all of the parts together which are between the plate 26 and the nut 42.

The shim 28 is preferably of substantially the same size as the plate 26 but is much thinner than the plate 26. The shim is preferably made of a thin resilient metal plate with a hole that fits loosely over the fastening element 30. The shim is formed with dimple-like openings having sharp burrs 43 projecting outwardly from the side which faces the cable shield 14. The side of the plate having the sharp points formed by the burrs 43 is preferably plated with indium metal. The sharp contacts on burrs 43 increase the contact pressure between the shim and the metal shield 14. Indium has the characteristic of being a good bearing metal. The shield 14 may be made of aluminum, which becomes non-conductive as a result of oxidation, but the sharp contacts of the shim 28 cut through such oxide as may form.

The spring 36 is an energy-storing device. When the parts are brought together, and the spring is compressed against the outer jacket 16 by the clamping shoe 40, the spring 36 is stressed and presses the outer jacket 16 and the metal shield 14 toward the shim 28 and maintains the contact pressure between the contacts of the shim 28 and the inside surface of the shield 14 in spite of changes in dimensions and cold flow of any of the parts.

The sharp burrs on the shim plate will cut through any thin plastic coating on the inner face of the metal shield 14 and make electrical connection with the metal shield. The indium plating on the burrs flows and forms a gas-tight seal at the contact points. Further tightening of the nut 42 stores compressive energy in the spring 36, and this compressive energy is automatically released to compensate for creep strain that tends to reduce the pressure on the electric contact points.

The clamping shoe 40 has walls 44 on opposite sides and another wall 46 which extends between the walls 44 at one end, and only one end, of the clamping shoe 40; with sharp edges at the bottoms of the walls 44. The sharp edges can be continuous straight line edges at the lower ends of the walls; but in the preferred construction, the sharp edges are saw tooth edges with triangular teeth as shown in FIGS. 1 and 2. The saw tooth edges make the clamping shoe 40 have less tendency to cut completely through the cable sheath tab 24. There is preferably no wall extending downward at the end of the clamping shoe opposite the end wall 46, because if there were there would be danger that such a cutting edge, away from the end of the cable, would cut off the tab 24 from the cable.

As the nut 42 is tightened during assembly of the structure, the knife edges 48 of the clamping shoe penetrate the plastic jacket 16 and confine part of it into an enclosed area within the walls 44 and 46 so as to prevent lateral movement of the tab 24 from creep or temperature fluctuation.

The height of the cutting edges 48 on the clamping shoe 40 can be varied for cables that employ very thick jackets; that is, different shoes can be provided. Complete cutting by the clamping shoe 40 of the outer jacket will not affect significantly the reliability of the connections. Cutting edges of the clamping shoe 40 can also be made in a tooth form for easier penetration into the sheath.

In order to insure high current-carrying capacity for the grounding connection, more than one tab in the composite cable sheath should be cut, and each should be fitted with a connector such as shown in FIG. 1. FIG. 4 shows diagrammatically a cable 10' equipped with three grounding connections 54, each of which has a ground wire 56 clamped between the nut 52 and a lock nut 58 screwed over the threaded fastening element 30 shown in FIGS. 1, 2, and 3, already described.

The preferred embodiment of the invention has been illustrated and described, but changes and modifications can be made, and some features can be used in different combinations without departing from the invention as defined in the claims.

What is claimed is:

1. A sheath bonding connector for grounding a communication cable that has a core surrounded by a metal shield that is covered on the outside by a plastic jacket, said connector including in combination an inner shoe located on the outside of the core contacts between the metal shield and the outside surface of the inner shoe in position to touch the inner surface of the metal shield, one of the contacts having a surface of non-corrosive metal, a fastening element extending outward from the shoe and through the metal shield and plastic jacket, the fastening element being electrically connected with the inner shoe, a clamping device on the outside of the plastic jacket and secured to the fastening element, a resilient energy-storing device that is held under tension by the clamping element when the connection is fully assembled and held under pressure by said fastening element, the resilient energy-storing device maintaining contact pressure in spite of cold flow of structure of the bonding connector.

2. The sheath bonding connector described in claim 1 characterized by the fastening element extending beyond the outside of the plastic jacket, the clamping device including a clamping shoe through which the fastening element extends, and means on the outer part of the fastening element for pressing the clamping shoe toward the outside of the plastic jacket.

3. The sheath bonding connector described in claim 2 characterized by the energy storing device including a resilient element between the outside of the plastic jacket and the clamping shoe, the resilient element being held stressed and under pressure by the force of the means of the outer part of the fastening element against the outside of the clamping shoe.

4. The sheath bonding connector described in claim 3 characterized by the resilient element being a spring through which the fastening element passes, the fastening element being a threaded screw, and the means on the outer part of the fastening element for pressing the clamping shoe being a nut that threads on the screw.

5. The sheath bonding connector for grounding a communication cable that has a core surrounded by a metal shield that is covered on the outside by a plastic jacket, said connector including in combination an inner shoe located on the outside of the core, contacts between the metal shield and the outside surface of the inner shoe in position to touch the inner surface of the metal shield, one of the contacts having a surface of non-corrosive metal, a fastening element extending outward from the shoe and through the metal shield and plastic jacket, the fastening element being electrically connected with the inner shoe, a clamping device on the outside of the plastic jacket and secured to the fastening element, a resilient energy-storing device operated by the clamping element and that maintains contact pressure in spite of cold flow of structure of the bonding connector, and further characterized by the clamping shoe having an area that overlies a corresponding area of the outside surface of the plastic jacket, and side walls projecting from opposite sides of said clamping shoe and toward the plastic jacket, said side walls having knife edges that project into the outside surface of the plastic jacket when the clamping shoe is forced against the plastic jacket by said means on the outer part of the fastening element.

6. The sheath bonding connector described in claim 5 characterized by the clamping shoe having a wall at one end, between the sidewalls, and with a knife edge for projecting into the plastic jacket, and the means on the outer end of the fastening element being a nut that screws over threads on said fastening element.

7. The sheath bonding connector described in claim 6 characterized by the plastic jacket being adhered to the metal shield, the knife edges on the clamping shoe projecting into the plastic of the jacket around the area of the jacket that overlies the part of the metal shield with which the contacts of the inner shoe touch the inner surface of the metal shield whereby the knife edges confine the jacket in an enclosed area so as to prevent lateral movement of the jacket and the metal shield resulting from creep or temperature fluctuations.

8. The sheath bonding connector described in claim 1 characterized by the inner shoe including a base plate and a shim thinner than the base plate and having a plurality of pointed protuberances on its outside surface that contacts with the inside surface of the metal shield to increase the contact pressure of the shim against the inside surface of the metal shield, the pointed protuberances being good conductors of electricity and being of non-corrosive metal that does not oxidize.

9. The sheath bonding connector described in claim 8 characterized by the shim having sharp burrs projecting outwardly from the side that is in contact with the metal shield, the side of the shim having the burrs projecting therefrom being plated with indium metal, and the metal shield being made of aluminum with a thin corrosion-protecting layer of plastic that is pierced by the burrs to make electric contact with the metal shield.

10. The sheath bonding connector described in claim 8 characterized by the shim being formed with dimple-like depressions on the inner side thereof, and the dimple-like depressions being shaped to form protuberances on the other side of the shim.

11. The sheath bonding connector described in claim 9 characterized by the resilient energy-storing device being a spring of roughly the same size as the shim for exerting pressure upward and downward in an area of the metal shield and plastic jacket overlying the shim, the burrs on the shims penetrating the corrosion-protecting plastic and contacting base aluminum and indenting the aluminum, and the indium being coated onto the vicinity of the burr contacts with the aluminum and forming gastight seals around the contact points to prevent corrosion and resulting increase of electrical resistance at the contacts.

12. The sheath bonding connector described in claim 1 characterized by the cable having the jacket adhered to the metal shield, a portion of the plastic jacket and metal shield being cut through along spaced lines extending longitudinally of the cable and along another line extending with a circumferential component from corresponding ends of said spaced lines to form a tab which can be bent outward along a hinge line remote from the line extending with a circumferential component to provide access to both sides of the tab for connecting the inner shoe, the fastening element, the clamping device, and the energy-storing device with the tab, and a wrap that holds the tab in its original position after the connections are made and the tab is returned to alignment with adjoining parts of the jacket and metal shield.

13. The sheath bonding connector described in claim 12 characterized by there being a number of tabs and the parts connected thereto at different circumferential locations on the same cable, the connectors for grounding the metal shield of the cable from said parts being at different locations along the cables.

14. The method of grounding an electric cable having a core, a metal shield surrounding the core, and a plastic jacket surrounding and adhered to said metal shield, which method comprises cutting through the jacket and metal shield along spaced and longitudinally extending lines, and along a line with a circumferential component between the spaced lines to form a tab that can be hinged upward at the ends of the spaced lines remote from the line with the circumferential component, hinging the tab upward, placing on the core a shoe having protuberances of non-corrosive metal on a face that will contact with the metal shield on the tab when the tab is brought into alignment with adjacent parts of the cable from which the tab was cut, passing a connecting element through the shoe, metal shield and jacket, locating a resilient energy-storing element in position to hold the protuberances against the shield with resilient pressure that maintains a firm contact in spite of cold flow of the grounding structure, clamping the tab against the shoe by pressure along said connector element at a location outside of the cable.

15. The sheath bonding connector described in claim 1 characterized by the non-corrosive metal being indium plating on one of the contacts.

16. An electrical connection comprising a first metal contact element having a surface, a second metal contact element having a surface of restricted area, and a coating of indium on one of the contact elements in position to touch the other contact element to close an electric circuit between the contacts.

17. The electrical connection described in claim 16 characterized by the first contact element having a soft metal surface, and the surface of the second contact element having a point as its contact area, the point being coated with indium and embedding itself in the surface of the first contact, and the indium coating on the point forming a gas-tight seal by cold flowing into the space around the point that becomes embedded in the surface of the first contact.

18. A sheath bonding connector for grounding a communication cable that has a core surrounded by a metal shield which is covered on the outside by a plastic jacket, said connector including in combination a fastening element extending outward from the core and through the metal shield and plastic jacket, a clamping device on the outside of the plastic jacket and secured to the fastening element, the clamping element being a shoe with side walls extending downward along two sides of the shoe and that are parallel to the longitudinal axis of the cable, and a transverse end wall extending between the side walls at one end of the shoe, said walls having cutting edges that cut into the plastic jacket when the shoe is forced against the jacket.

19. The sheath bonding connector described in claim 18 characterized by the metal shield and plastic jacket having a tab disconnected from the plastic jacket along an end portion of the cable and for a distance back from the end of the cable, which distance is greater than the length of the shoe, the cutting edges being toward the end of the cable and inward from but parallel to the sides of the tab, the tab being hinged to the plastic jacket at a location remote from the end of the cable and across a circumferential distance between the parallel sides of the tab, and the shoe being free of any cutting edges at the region where the tab is hinged to the plastic jacket.

* * * * *